United States Patent [19]

Boyle et al.

[11] Patent Number: 5,056,708

[45] Date of Patent: Oct. 15, 1991

[54] TWO-CELL SLIDE TOP DISPENSER WITH TAMPER EVIDENT TOP

[75] Inventors: Daniel J. Boyle, Hartland, Wis.; Herbert L. Lambert, Chicago, Ill.

[73] Assignee: Waldorf Corporation, St. Paul, Minn.

[21] Appl. No.: 573,363

[22] Filed: Aug. 27, 1990

[51] Int. Cl.[5] ..... B65D 5/72

[52] U.S. Cl. ..... 229/120.03; 206/621.8; 229/120.18

[58] Field of Search ..... 206/621.8; 229/120.03, 229/125.12, 120.18

[56] References Cited

U.S. PATENT DOCUMENTS

| | | | |
|---|---|---|---|
| 2,628,761 | 2/1953 | Yancey | 206/621.8 |
| 2,950,851 | 8/1960 | Peimer | 206/621.8 |
| 4,094,456 | 6/1978 | Roccaforte . | |
| 4,141,485 | 2/1979 | Lambert | 206/621.8 |
| 4,201,329 | 5/1980 | Roccaforte . | |
| 4,361,270 | 11/1982 | Roccaforte | 229/120.03 |
| 4,548,318 | 10/1985 | Boyle . | |
| 4,609,142 | 9/1986 | Adamek | 206/621.8 |

FOREIGN PATENT DOCUMENTS

| | | | |
|---|---|---|---|
| 1070212 | 6/1967 | United Kingdom | 229/120.03 |

*Primary Examiner*—Stephen Marcus
*Assistant Examiner*—Christopher McDonald
*Attorney, Agent, or Firm*—Dorsey & Whitney

[57] ABSTRACT

An improved reclosable dispensing carton is provided. The carton includes a dispensing end having a plurality of flaps which, when the carton is closed, are in parallel planes. The flaps include major inside and outside flaps and a pair of slide slidably positioned therebetween. A removable security tab is provided on the major outside flap and is removably affixed to both slide flaps prior to opening the carton.

14 Claims, 5 Drawing Sheets

TWO-CELL SLIDE TOP DISPENSER WITH TAMPER EVIDENT TOP

TECHNICAL FIELD

The present invention relates to dispensing cartons for dispensing small individual articles of food such as small candy pieces or the like. More particularly, the present invention relates to a reclosable dispensing carton wherein two different kinds of candy may be dispensed from the same carton through two dispensing openings which may be independently opened and closed by independent, slidable flaps.

BACKGROUND OF THE INVENTION

The dispensing carton of the present invention is an improvement over the inventions disclosed in U.S. Pat. Nos. 4,361,270, 4,201,329 and 4,094,456.

The invention disclosed in U.S. Pat. No. 4,361,270 is a dispensing carton adapted for containing and dispensing small candies and includes a pair of internal compartments closed at one end. The upper or dispensing end of the carton has closure flaps that include two sets of registered openings, each set of openings aligned with one of the compartments, and a pair of independently operable sliding tabs which lie between the overlapping closure flaps. The sliding tabs slide between the flaps to open or close the openings.

U.S. Pat. No. 4,548,318 discloses a reclosable dispensing carton wherein the front wall of the carton has a nicked out circular portion. The central portion of a top wall panel extension has a debossed circular area adapted to overlie and be glued to the nicked out part of the front wall. When the central portion is pulled, the nicked out area adheres to it and is removed from the front wall to form a dispensing opening. The cover flap may be pushed back against the carton wall to cause the nicked out area to frictionally lock within the opening to reclose the carton. In a multi-cell version of this carton, each cell has its own dispensing opening with the structure just described.

While the above-cited prior art represents improvements in reclosable dispensing cartons for dispensing one or more flavors of candy or other kinds of material from the same carton, there are some problems that the cited patents do not address. One such problem is that the prior art cartons may not always provide good evidence of tampering with the carton. In the case of the carton with the slidable tabs (patent '270), someone could cut around the openings, open the slide tabs, tamper with the product and close the tabs leaving slight evidence of the tampering. Likewise, in the case of the reclosable carton with the friction lock (patent '318), tampering would not be immediately apparent, particularly to a child, because the cover flap overlies and tends to obscure the opening into the carton.

Another problem is that the packages disclosed in the prior art may be difficult to open because a consumer must tear through two layers of carton wall or must tear away two or more removable tabs secured to the carton by adhesive to expose the dispensing opening(s).

Therefore, a reclosable dispensing carton for containing and dispensing one or more varieties of material and providing tamper evidence, which is easy to open and close and which may be produced efficiently and inexpensively would be a decided improvement over the dispensing containers disclosed in the prior art.

SUMMARY OF THE INVENTION

The present invention is an improved reclosable dispensing carton, particularly adapted for dispensing one or more flavors of small candy items. The generally rectangular, tubular carton has front and rear walls, opposed side walls foldably attached to the front and rear walls, a closed bottom end and a reclosable top dispensing end. The top or dispensing end comprises a plurality of closure flaps in parallel, planar relationship when the carton is fully closed. The closure flaps include an inside major flap foldably connected to the rear wall and having at least one aperture therethrough, an outside major flap foldably connected to the front wall of the carton and incorporating a generally central security opener tab, and two minor articulated slide flaps foldably and flexibly connected to the side walls of the carton. The slide flaps are slidably positioned between the inside major flap and the outside major flap.

To form the carton into its point of sale configuration, it is first formed as a tube with a rectangular cross-section with one closed end. To close the top or dispensing end, the inside major flap is folded or rotated inwardly toward the carton to underlie the remaining top closure flaps. Next, the two slide flaps are folded inwardly toward one another to overlie the inside major flap. The outside major flap is then folded downwardly about the top end of the carton and may be secured to the rear wall of the carton with a glue panel.

For dispensing, the security opener tab is removed from the outside major flap, thus freeing each of the articulated slide flaps for separate reciprocating motion between the outside major flap and the inside major flap, whereby items contained in the package may be dispensed through one or the other or both the openings in the inside major flap. The invention also encompasses a flat blank that may be folded and locked or glued into the preceding package configuration. The blank may be made from a paperboard or other suitable material.

One object of the present invention is to provide a reclosable dispensing carton providing improved tamper resistance and more apparent evidence of attempted tempering.

Another object of the present invention is to provide a reclosable dispensing carton that may be manufactured efficiently resulting in a less expensive carton.

A further objective of the present invention is to provide a reclosable dispensing carton that is easy to open and reclose, yet protects the material contained therein from contamination and reduces the likelihood that the package itself may be crushed or broken open.

Other objects and advantages of present invention will become more fully apparent and understood with reference to the following specification and to the appended drawings and claims.

DETAILED DESCRIPTION OF THE PREFERRED EMBODIMENT

Figure 4:
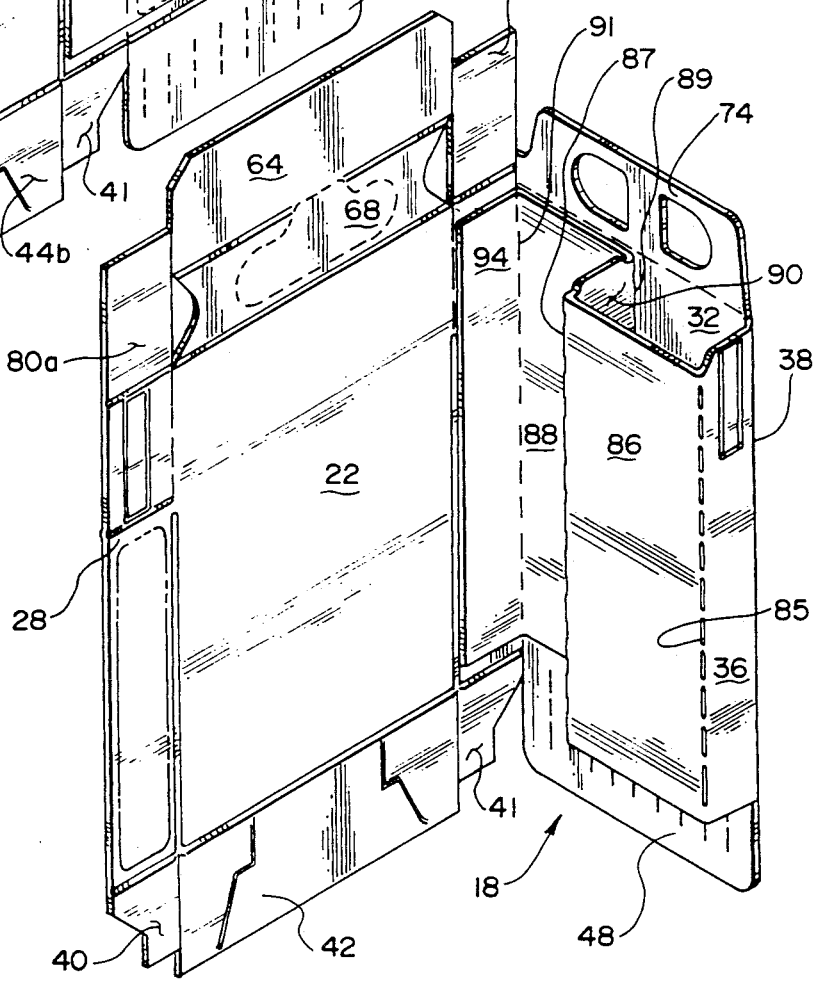
FIG. 4 is a perspective view of a partially erected carton showing the formation of the internal cells of the carton.
Figure 5:
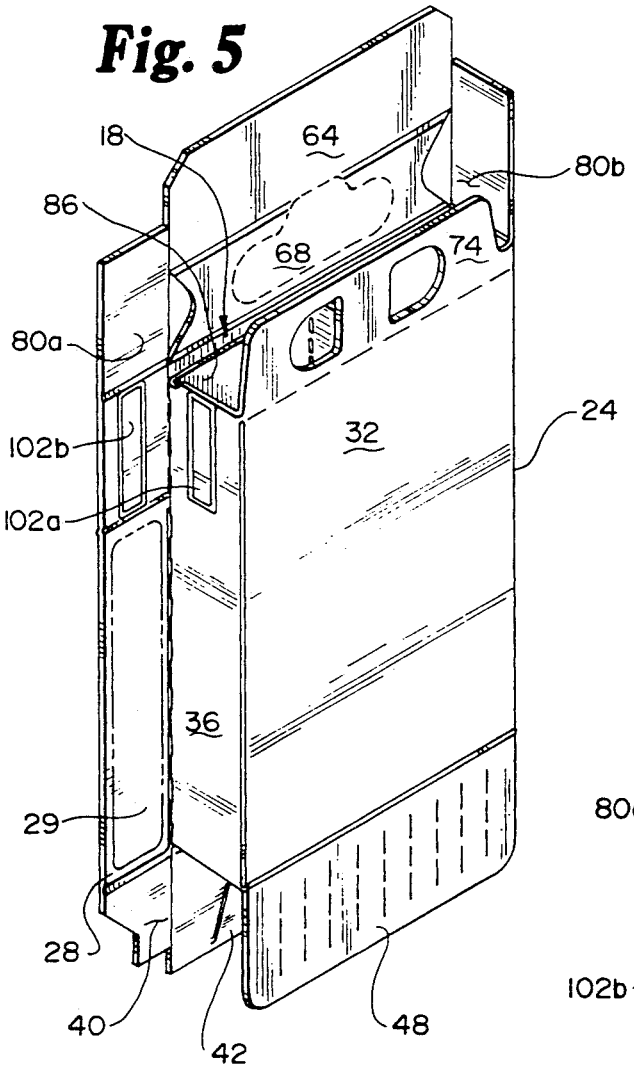
FIG. 5 is a perspective view depicting the partially erected carton of present invention just prior to being glued into its generally tubular configuration.
Figure 9:
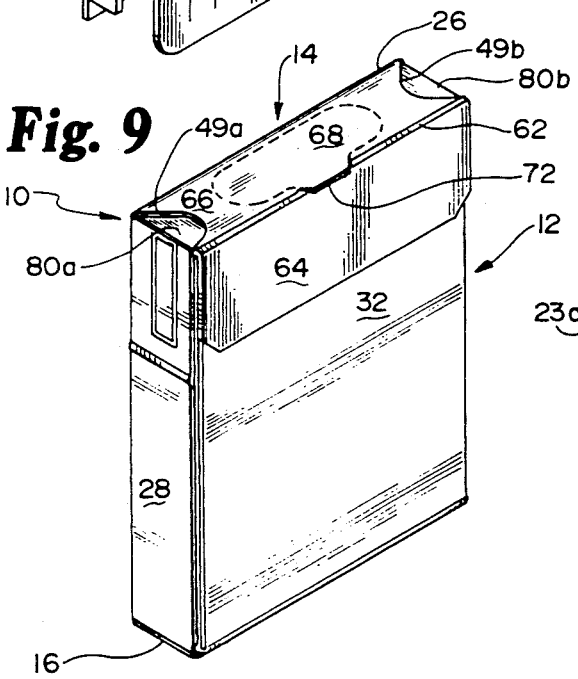
FIG. 9 is a perspective view of the present invention as it appears at the point of sale.

As best seen in FIG. 9, a completed carton 10 in accordance with the present invention has an outer shell or body 12, a top end 14, a bottom end 16. It also has an interior cell structure 18 (as best seen in FIGS. 4 and 5).

Figure 1:
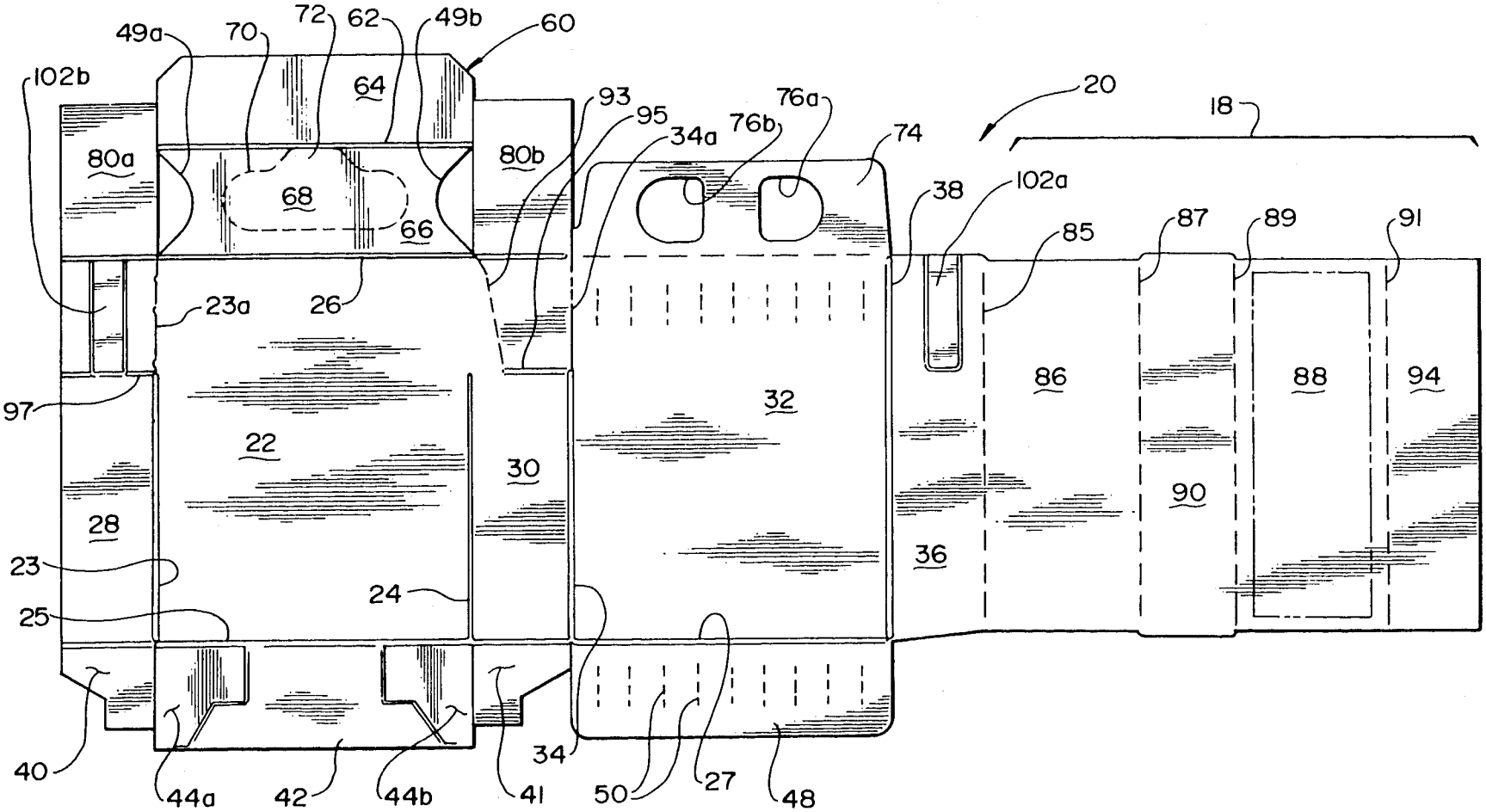
FIG. 1 is a top plan view of the inside surface of the blank from which the carton of the present invention may be formed and shows the die cut profile thereof.
Figure 2:
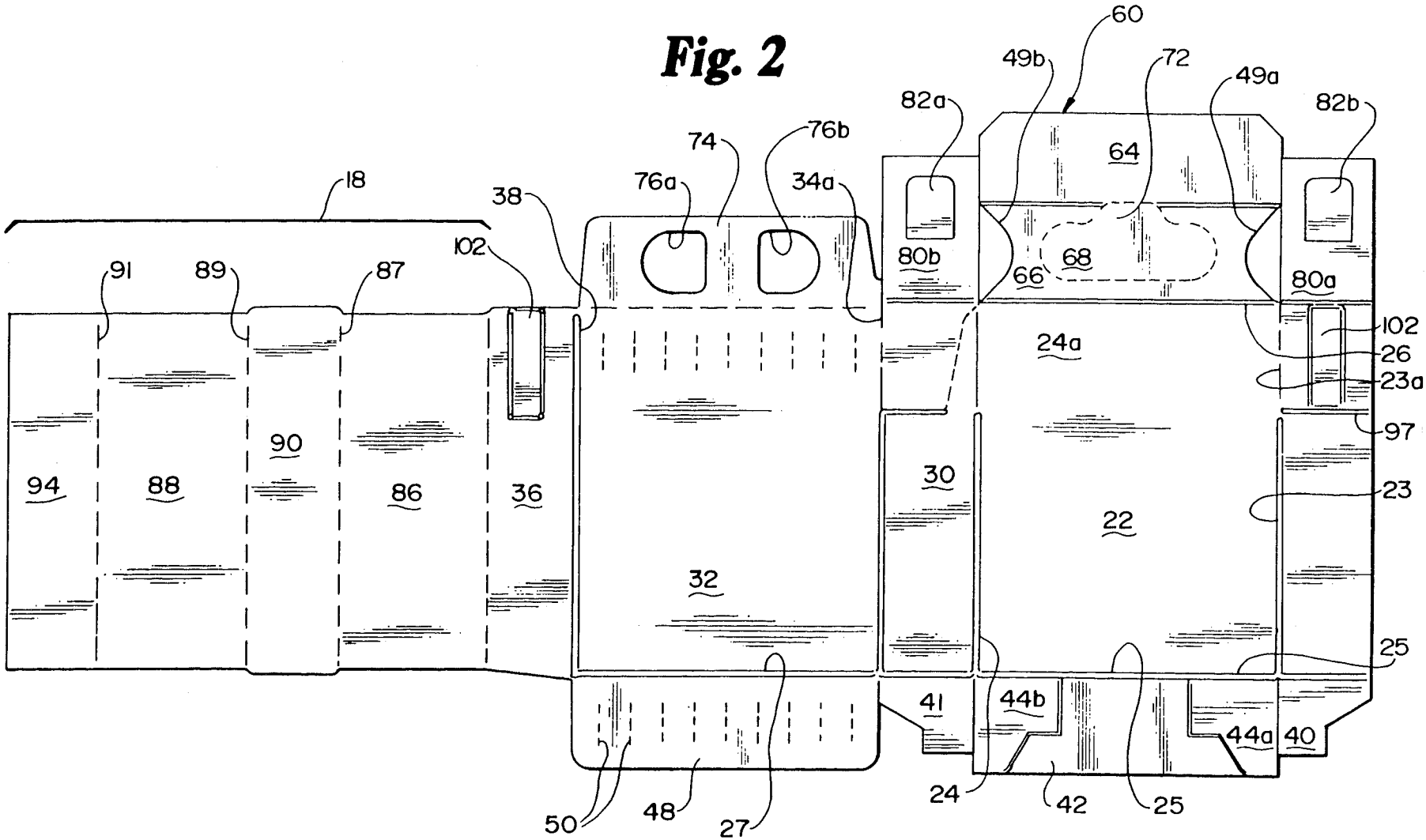
FIG. 2 is a top plan view of the outside surface of the blank from which the carton of the present invention may be formed and shows the die cut profile thereof.
Figure 3:
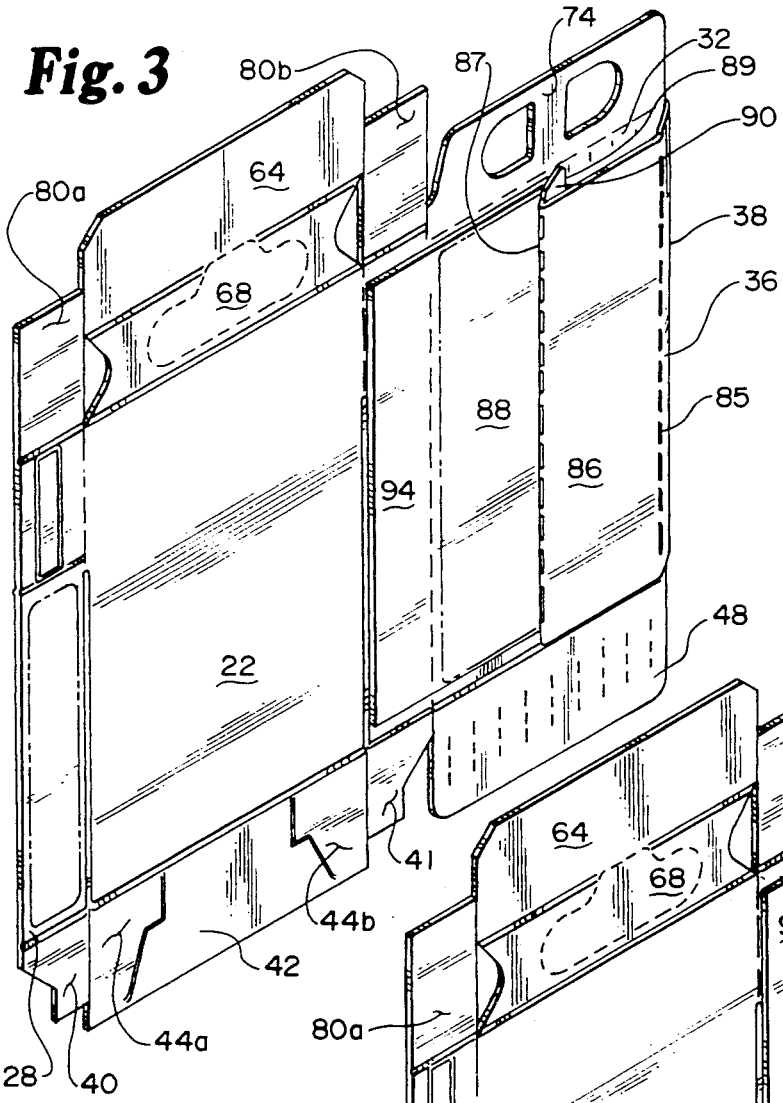
FIG. 3 is a perspective view depicting the result of the first steps in the erection of the carton.

FIG. 1 depicts the inside surface and FIG. 2 the outside surface of a blank 20 for forming, in accordance with the present invention, the carton 10 as depicted in FIG. 9. The blank 20 has a central generally rectangular front wall panel 22 with four fold lines 23, 24, 25, 26 defining its two opposed pairs of edges. (In the drawings, double lines indicate scores used to form fold lines. Single solid lines indicate cuts or free edges, except where otherwise indicated.) Attached to the opposed parallel edges 23, 24 are right and left side wall adhesion panels 28, 30. A central, rear wall panel 32 is connected to the left side wall adhesion panel 30 along fold line 34, parallel to fold line 24 at the opposite side of panel 30. At the opposite side of the rear side wall panel 32, a right side cell wall and adhesion panel 36 is connected to the rear panel along fold line 38.

To form the bottom end 16 of the carton 10, the blank 20 includes minor closure flaps 40, 41 connected to the right and left side wall adhesion panels 28, 30 at extensions of fold line 25. A major outside bottom end closure panel 42 is connected to the front wall panel 22 along fold line 25. The major outside closure panel 42 is provided with embossed seats 44*a*, 44*b* at each end thereof for compensating for thickness of the minor closure flap panels 40, 41 when the bottom end 16 of the carton 10 is in its closed position as depicted in FIG. 9. For completing the bottom end 16, the rear wall panel 32 has a major inside bottom end closure panel 48 attached thereto at fold line 27. The panel 48 includes a plurality of adhesive score lines 50 formed thereon.

FIGS. 1 and 2 also show the portions of the blank 20 which form the top end 14 of the carton 10. Specifically, the blank 20 includes a major outside top end closure panel 60 which is foldably attached to the front side wall panel 22 along fold line 26. The major outside top end closure panel 60 includes a fold line 62 that separates the panel 60 into two subpanels, a glue panel 64 and an opening panel 66. A security opener tab 68 is incorporated in the opening panel 66, formed by a continuous, curved perforated line 70. The security opener tab includes a finger tab 72, whereby the security opener tab 68 may be grasped easily for removal of the tab 68. At opposite sides of the opening panel 66 are slide panel cutout edges 49*a*, 49*b*.

The blank 20 also includes a major inside top end closure panel 74. The closure panel 74 is provided with two "D"-shaped dispensing holes 76*a*, 76*b*. The holes 76*a*, 76*b* are spaced from the center of the closure panel 74 as well as from the ends of that panel. Although only two dispensing holes 76*a*, 76*b* are shown in the Figures, it is not beyond the scope of the present invention that one, two, or more such holes may be provided, depending upon and corresponding to the number of cells in the interior cell structure 18.

The top end 14 also includes minor slide closure flaps 80*a*, 80*b* which are attached to the right and left side wall adhesion panels 28, 30. As best seen in FIG. 2, the slide flaps 80*a*, 80*b* are provided with superficial, partial cuts or scores defining delamination control areas 82*a*, 82*b* therein. The function of these areas 82*a*, 82*b* will be described more fully herein below. It should be noted that slide flap 80*a* is connected by an extension of fold line 26 to a flexing or articulated portion of the panel 28 that is bounded by perforated fold line segment 23*a* (an extension of fold line 23) and flex fold line 97. Somewhat similarly, slide flap 80*b* is connected by an extension of fold line 26 to a flexing articulated portion of panel 30 bounded by perforated diagonal edge 93, flex fold line 95 and perforated fold line segment 34*a* (an extension of fold line 34).

FIGS. 1 and 2 also show the portions of the blank 20 that form the interior cell structure 18. The cell structure 18 is formed by a front cell wall panel 86 and a rear cell wall panel 88, with a cell divider panel 90 foldably positioned between the cell wall panels 86, 88. The front cell wall panel 86 is foldably connected to the right side cell wall and adhesion panel 36 at fold line 85. The panels for the cell structure 18 terminate with a left cell wall panel 94. The various panels 86, 90, 88 and 94 making up the cell structure 18 are foldably connected by perforated fold lines 87, 89, 91 parallel to each other and to fold line 85.

FIGS. 3 through 6 depict the erection of the carton 10 formed from the blank 20. First, one-hundred eighty degree folds are made at fold lines 38 and 87 with a reverse one-hundred eighty degree fold at fold line 89. Panel 88 is brought into contact with and glued to panel 32. When the resulting preliminary cell structure springs back slightly, the partially erected carton appears as in FIG. 3. Adhesive secures panel 88 to the rear wall panel 32. As shown in FIG. 4, a fold is made at superimposed fold lines 91 and 34/34*a* and the structure of panels 36, 86 and 90 is permitted to spring up so that the carton end profile is "S" shaped and the cell divider panel 90 becomes perpendicular to the rear wall panel 32.

Figure 6:
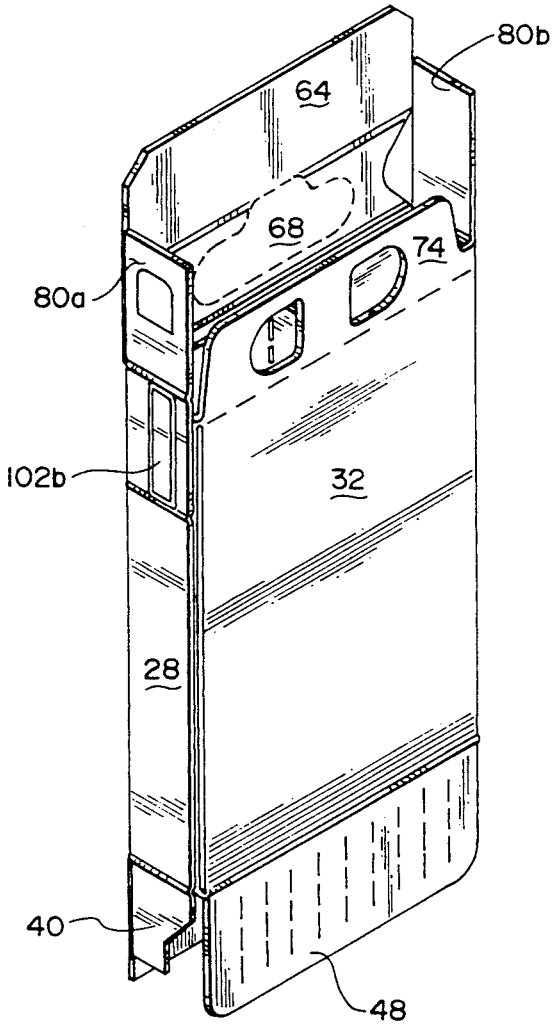
FIG. 6 is a perspective view of an erected carton just before closure of the top and bottom ends.

As depicted in FIG. 5, the cell structure 18 and the rear side wall panel 32 have been pivoted or folded about the fold line 24 until the front side cell wall panel 86 contacts the inside surface of the front wall panel 22. As shown in FIG. 6, the right side wall panel 28, with glue area 29, is then brought into contact with the right side cell wall and adhesion panel 36.

It should be noted that the cell wall and adhesion panel 36 and the right side wall 28 are provided with embossed and debossed adhesive release areas 102*a*, 102*b*, respectively, whereby adhesive placed therein will be less compressed and dispersed when the adjacent panels are brought together. This permits the resulting adhesive bonds to be more easily broken and also controls delamination, restricting any delamination to a limited area. Once panels 28 and 36 are secured to each other, the carton 10 is ready for the top end 14 to be closed. Specifically, the major inside top end closure panel 74 is folded inwardly toward the carton interior.

Figure 8:
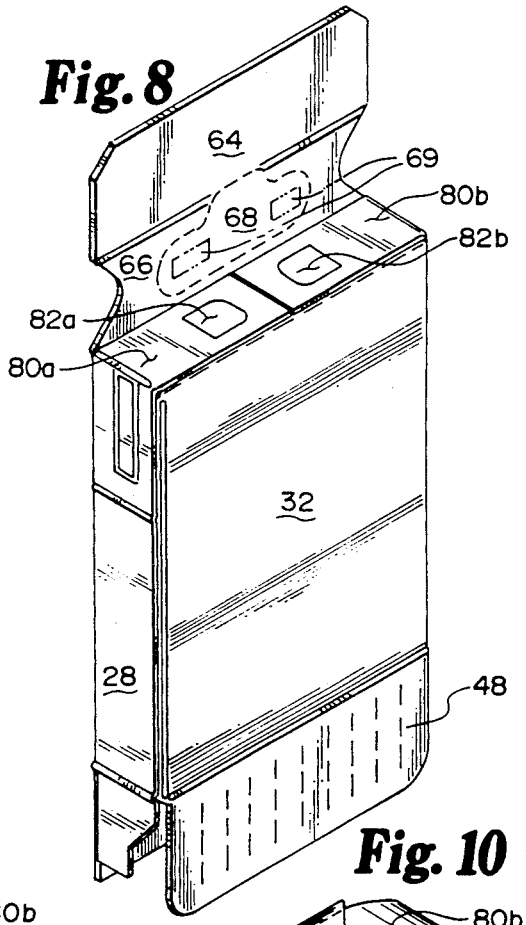
FIG. 8 is a perspective view of the top dispensing end just prior to closure of the outermost panel.

Each one of the dispensing holes 76*a*, 76*b* can be seen to be aligned with one of the two cells of the interior cell structure 18. Next, as depicted in FIG. 8, the minor slide closure flaps 80*a*, 80*b* are folded inwardly and downwardly to overlie the dispensing holes 76*a*, 76*b*. The bottom end 16 of the carton 10 may be left open as shown in FIG. 8, until the material to be contained in and dispensed from the carton 10 is placed into the carton 10 from that end.

FIG. 9 shows the carton 10 with the top end 14 and the bottom end 16 completely closed, as it might appear at a point of sale. The major inside bottom end closure panel 48 has been folded toward the carton interior, with minor closure flaps 40, 41 folded onto panel 48. Closure of the bottom end 16 is completed by folding the major outside bottom end closure panel 42 onto the previously folded panel 48 and flaps 40, 41, such that the embossed seats 44*a*, 44*b* align with the flaps 40, 41. At the top end 14, the major outside top (or dispensing) end closure panel 60 has been folded downwardly about the fold line 26 and the glue panel 64 has been folded down about the fold line 62, which now becomes an edge at the top end 14 of the carton 10. The inside of opening panel 66 in the area of security opener tab 68 is glued by adhesive to the delamination control areas 82*a*, 82*b* on slide flaps 80*a*, 80*b*. The glue panel 64 has also been glued to the outside surface of the rear panel 32. It should be appreciated that the security opener tab 68 now overlies the minor slide flaps 80*a*, 80*b* and the dispensing holes 76*a*, 76*b* in the major inside panel 74. FIG. 9 also shows that the finger extension 72 extends slightly beyond the fold line 62, whereby a consumer may easily grasp the finger extension 72 to remove the security opener tab 68 from the opening panel 66.

Figure 10:
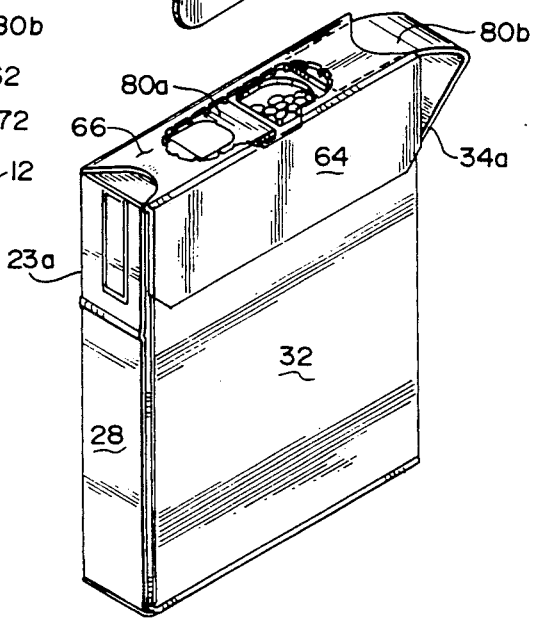
FIG. 10 is a perspective view of the present invention as it appears after opening by a consumer.

In FIG. 10, the top end 14 of the carton 10 is shown after the security opener tab 68 has been removed therefrom (which can be done in a single upward tearing motion) to open the carton 10 and gain access to the material within. When the tab 68 has been torn along the perforated line 70 and removed, the glue bonds between tab 68 and delamination control areas 82*a*, 82*b* cause delamination of the top layer of material in the areas 82*a*, 82*b* and the slide flaps 80*a*, 80*b* are no longer joined to tab 68. Once this occurs, a consumer simply exerts a lateral outward and downward force on one or both of the slide flap or flaps 80*a*, 80*b*, by pressing and pulling out on the portions of the slide flaps 80*a*, 80*b* exposed at slide panel cutout edges 49*a*, 49*b*. When this is done with slide flap 80*a*, the perforations at fold line segment 23*a* are broken, the glue bond between embossed and debossed areas 102*a*, 102*b* is broken, and the upper portion of the panel 28 flexes to allow slide flap 80*a* to be partially withdrawn from between panels 74 and 66 to expose the dispensing hole 76*a* in the inside panel 74. Similarly, when slide flap 80*b* is pressed and pulled outward, the perforations at line 93 and at fold line segment 34*a* are broken and the upper portion of the panel 30 flexes to allow slide flap 80*b* to be partially withdrawn to expose dispensing hole 76*b*. Either one of the holes 76*a*, 76*b* may be opened individually or both may be opened at the same time. The carton 10 of the present invention may be easily reclosed by exerting on the slides 80*a*, 80*b* a force in the direction of the center of the panel 66.

With reference to the adhesive release embossments and debossments provided for in the present invention, these embossments 102*a*, 102*b* receive adhesive between the right side wall adhesion panel 28 and the right side cell wall and adhesion panel 36. The embossments provide additional space between those portions of the carton 10, whereby the compressive force on the adhesive between the panels and flaps is lessened so that the bond formed by the adhesive may be more easily broken. The embossments also help to confine adhesive, usually liquid or semi-liquid when applied, to a specific area of the carton. This is advantageous, particularly at the right side wall adhesion panel 28 where a purchaser of the package must exert an outward force breaking the bond between the panels 28, 36 to manipulate the slide 80*a* in and out to expose the hole 76*a* on that side of the carton 10. On the opposite side of the carton 10, the sidewall has perforated lines 93, 34*a* and a hinge line 95 to facilitate the movement of the slide 80 of the carton walls to those specific areas thereby assisting in maintaining carton integrity.

In summary, it will be seen that the present invention is an improved, reclosable dispenser carton opener structure. The security opener tab 68 provides a seal that is easily removed when desired. Its surrounding perforations and the glue bonds between it and the delamination areas 82*a*, 82*b* of slide flaps 80*a*, 80*b* provide tamper evidence when broken. Tamper evidence is likewise present if an attempt is made to remove either slide flap 80*a*, 80*b* without removing tab 68, due to the need to break perforations at lines 93, 34*a* and 23*a* to move the slide flaps.

It will be seen that the present invention could be modified by changing the shape of the security opener tab 68, so long as it is removable as one piece and its removal causes at least a portion of each of the underlying holes 76*a*, 76*b* to be revealed. Similarly, other flexing structures at the top of panels 28, 30 could be used to permit slide flaps 80*a*, 80*b* to slidably reciprocate between panels 66 and 74. A tubular carton with a triangular or hexagonal cross-section could be constructed with three or more radially directed cells internally, each one having a slide flap and an inner hole revealed by removal of the corresponding slide flap, with all of the inner holes being covered and secured by a single security opener tab overlying all of them.

Although the description of the preferred embodiment has been presented, it is contemplated that various changes, including those mentioned above, could be made without deviating from the spirit of the present invention. It is desired, therefore, that the present embodiment be considered in all respects as illustrative, not restrictive, and that reference be made to the appended claims rather than to the foregoing description to indicate the scope of the invention.

What is claimed and desired to be protected by Letters Patent is:

1. A carton having a multi-layered, dispensing end closure, said carton having front and rear walls, opposed side walls connected to and extending between said front and rear walls, a closed bottom end and a top dispensing end, said dispensing end closure comprising a plurality of panels in parallel, planar relationship including:

an inside major panel having opposed front and rear edges and opposed side edges, said panel connected to said rear wall along the rear edge thereof, said panel having at least one aperture;

an outside major panel comprising an opening panel and a glue panel, said opening panel foldably connected to said front wall and said glue panel foldably connected to said opening panel, said opening panel having a generally central security opener tab therein, said tab defined by a continuous perforated line of weakness;

two opposed minor slide flaps, one of said slide flaps foldably connected to each of said side walls; and wherein said inside major panel, outside major panel and slide flaps are in overlying relationship and at least a portion of said security opener tab overlies said at least one aperture, one of said slide flaps interposed between

2. The carton as recited in claim 1, wherein said carton has two separate, interior cells and wherein said inside major panel has two apertures, one opening into each of said cells.

3. The carton as recited in claim 2, wherein said side walls include articulation means operably connected to said slide flaps for enabling said slide flaps to reciprocatingly slide between said outside major panel and said inside major panel.

4. The carton as recited in claim 3, wherein said security opener tab in said opening panel is generally oblong and is defined by a continuous, curved line of spaced perforations, including at least one perforation that is colinear with the side of said opening panel opposite the side where said opening panel is connected to said front wall.

5. A multi-layer, dispensing end closure for cartons, said closure comprising a plurality of panels in parallel, planar relationship including:

an underlying, innermost major panel having at least two apertures therethrough;

an overlying outermost panel comprising an opening panel and a glue panel foldably joined to said opening panel, said opening panel having a generally central removable security opener tab therein;

two opposed minor slide flaps interposed between said underlying panel and said overlying panel whereby said slide flaps may reciprocate therebetween, each of said slide flaps being slidably positionable relative to one of said apertures to selectively cover or uncover said one of said apertures; and wherein, when said end closure is closed before the initial opening, said removable security opener tab is releasably, adhesively affixed to each one of said slide flaps, and after said closure is opened, said security tab is removed from said end closure and said slide flaps may reciprocate between said overlying and said underlying flaps in a plane parallel thereto.

6. A dispensing structure for a wall of a carton for dispensing materials from two or more separate cells within said carton, comprising:

a first, inner panel having at least one dispensing hole therein corresponding to each of the internal cells;

a second, outer panel overlying the inner panel, said outer panel having a single security opener tab formed therein by a closed curve of perforations positioned such that the security opener tab overlies at least a portion of each of the dispensing holes; and a slide flap associated with each dispensing hole, each said slide flap being interposed between said inner and outer panels and slidably mounted therebetween for reciprocal motion, each said slide flap being initially releasably, adhesively connected to said security opener tab, such that removal of the security opener tab releases the adhesive connection between the security opener tab and each slide flap for said sliding reciprocal motion.

7. A flat blank for forming a reclosable dispensing carton, comprising:

two generally rectangular central wall panels each having a pair of opposed parallel side edges and a pair of opposed, parallel end edges;

a first side panel having two side edges and two end edges and being foldably attached to one of said central wall panels along one side edge of said one central wall panel;

a second side panel having two side edges and two end edges and being attached to and foldably interconnecting said two central wall panels such that the end edges of the central wall panels and first and second side panels form a first group of substantially aligned end edges along one side of the blank and a second group of substantially aligned end edges along the other side of the blank;

carton interior cell structure means for forming a carton interior cell structure, comprising a plurality of foldably connected panels, said interior cell structure means foldably attached to the remaining side edge of said one central wall panel;

bottom end closure means for forming a closed carton bottom, comprising a plurality of panels foldably attached to the first group of substantially aligned end edges of said central wall panels and said side panels; and top end dispensing closure means for forming a closed carton top, comprising a plurality of panels foldably attached to the second group of substantially aligned end edges of said central wall panels and said side panels, including a major inside panel attached to one of said central wall panels and having at least one aperture therethrough, a major outside panel attached to the other of said central wall panels and having an opener tab formed therein, and two minor slide flaps, each said slide flap having means for releasably affixing said slide flap to said opener tab.

8. The flat blank as recited in claim 7, wherein said major outside panel having said opener tab comprises an opening subpanel and a gluing subpanel, said subpanels being connected along a generally medial fold line in said outside panel, said fold line being generally parallel to the end edges of the second group of substantially aligned end edges.

9. The flat blank as recited in claim 8, wherein said opener tab further comprises a generally oblong portion of said major outside panel, said portion being generally centered in said opening subpanel.

10. The flat blank according to claim 7, wherein said means for releasably affixing said slide flaps to said opener tab comprises tamper evidencing means for providing visible evidence of the release of said opener tab from either of said slide flaps.

11. The flat blank according to claim 10, wherein said tamper evidencing means comprises a delamination area on each of said two slide flaps.

12. The flat blank according to claim 7, wherein said means for releasably affixing said slide flaps to said opener tab comprises an adhesive receiving delamination area on each of said two slide flaps, said area defined by a score line.

13. A carton having a multi-layered, dispensing end closure, said carton having front and rear walls, opposed side walls connected to and extending between said front and rear walls, a closed bottom end and a top dispensing end; said dispensing end closure including:

an inside major panel having opposed front and rear edges and opposed side edges, said panel connected to said rear wall along the rear edge of said rear wall, said panel having at least one aperture;

an outside major panel comprising an opening panel and a glue panel, said opening panel foldably connected to said front wall and said glue panel foldably connected to said opening panel, said opening panel having a generally central security opener tab therein, said tab defined by a continuous perforated line of weakness;

at least one minor slide flap foldably connected to one of said side walls; and wherein said inside major panel, outside major panel and at least one slide flap are in overlying relationship and at least a portion of said security opener tab overlies said at least one aperture, said at least one slide flap interposed between the outside major panel and said at least one aperture, said security opener tab being releasably affixed to said at least one slide flap.

14. The carton as recited in claim 13, wherein said side wall to which said at least one slide flap is connected includes articulation means for enabling said slide flap to reciprocatingly slide between said outside major panel and said inside major panel.

* * * * *

UNITED STATES PATENT AND TRADEMARK OFFICE

CERTIFICATE OF CORRECTION

PATENT NO. : 5,056,708

DATED : October 15, 1991

INVENTOR(S) : Daniel J. Boyle et al.

It is certified that error appears in the above-identified patent and that said Letters Patent is hereby corrected as shown below:

In column 3, line 62, insert "68" after --tab--.

Figure 7:
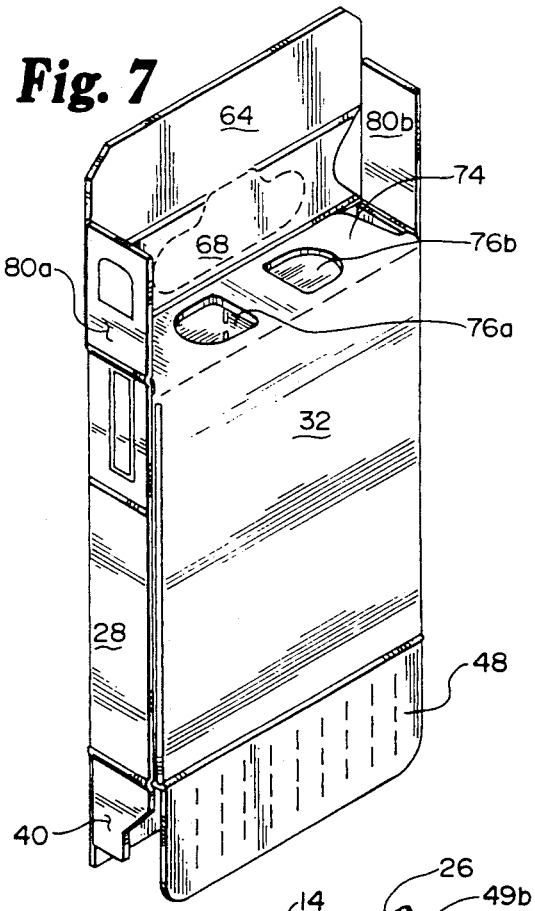
FIG. 7 is a perspective view of the present invention depicting the top dispensing end partially closed by inward folding of the innermost panel.

In column 4, line 67, insert "Figure 7 depicts the first step in forming the top end closure." before --Specifically--.

In column 7, line 10, insert "the outside major panel and said at least one aperture, said security opener tab being releasably affixed to each of said slide flaps" after --between--.

Signed and Sealed this

Thirteenth Day of July, 1993

*Attest:*

Michael K. Kirk

MICHAEL K. KIRK

*Attesting Officer*

*Acting Commissioner of Patents and Trademarks*